US009745175B2

(12) United States Patent
Assfalg

(10) Patent No.: US 9,745,175 B2
(45) Date of Patent: Aug. 29, 2017

(54) METHOD OF OPERATING A CRANE AND CRANE

(71) Applicant: Liebherr-Werk Biberach GmbH, Biberach an der Riss (DE)

(72) Inventor: Martin Assfalg, Attenweiler (DE)

(73) Assignee: Liebherr-Werk Biberach GmbH, Biberach an der Riss (DE)

( * ) Notice: Subject to any disclaimer, the term of this patent is extended or adjusted under 35 U.S.C. 154(b) by 133 days.

(21) Appl. No.: 14/429,349

(22) PCT Filed: Sep. 18, 2013

(86) PCT No.: PCT/EP2013/002816

§ 371 (c)(1),
(2) Date: Aug. 13, 2015

(87) PCT Pub. No.: WO2014/044391

PCT Pub. Date: Mar. 27, 2014

(65) Prior Publication Data

US 2015/0375972 A1 Dec. 31, 2015

(30) Foreign Application Priority Data

Sep. 18, 2012 (DE) ..... 10 2012 018 392

(51) Int. Cl.
*B66C 23/26* (2006.01)
*B66C 23/66* (2006.01)
(Continued)

(52) U.S. Cl.
CPC ..... *B66C 23/18* (2013.01); *B66C 23/166* (2013.01); *B66C 23/26* (2013.01); *B66C 23/36* (2013.01); *B66C 23/66* (2013.01)

(58) Field of Classification Search
CPC ..... B66C 23/166; B66C 23/18; B66C 23/26; B66C 23/36; B66C 23/00; B66C 23/06;
(Continued)

(56) References Cited

U.S. PATENT DOCUMENTS 4,506,791 A * 3/1985 Brosigke ..... B66C 23/605 212/257
2003/0160016 A1* 8/2003 Ortiz ..... B66C 23/42 212/300
2012/0223042 A1* 9/2012 McNiff ..... B66C 23/166 212/295

FOREIGN PATENT DOCUMENTS

CN 87200092 U 11/1987
CN 2033001 U 2/1989
(Continued)

OTHER PUBLICATIONS

State Intellectual Property Office of the People's Republic of China, First Office Action and Search Report Issued in Chinese Patent Application No. 201380057106.9, Dec. 23, 2015, 15 pages.
(Continued)

*Primary Examiner* — Sang Kim
*Assistant Examiner* — Juan Campos, Jr.
(74) *Attorney, Agent, or Firm* — McCoy Russell LLP

(57) ABSTRACT

The invention relates to a method of operating a crane having a luffable crane boom and having a trolley travelable at the crane boom, wherein the crane can be operated in a luffing mode, on the one hand, and in a trolley mode, on the other hand. In accordance with the invention, a switch is made between a luffing mode and a trolley mode by varying the hoist rope reeving. The invention further relates to such a crane for carrying out the method.

16 Claims, 3 Drawing Sheets

(51) Int. Cl.

| | |
|---|---|
| ***B66C 23/18*** | (2006.01) |
| ***B66C 23/16*** | (2006.01) |
| ***B66C 23/36*** | (2006.01) |

(58) Field of Classification Search
CPC ..... B66C 23/16; B66C 23/163; B66C 23/365; B66C 23/62; B66C 23/64; B66C 23/66; B66C 23/70; B66C 25/00
See application file for complete search history.

(56) References Cited

FOREIGN PATENT DOCUMENTS

| | | | |
|---|---|---|---|
| DE | 1171132 | B | 5/1964 |
| DE | 4447384 | A1 | 6/1996 |
| FR | 1007775 | A | 5/1952 |
| FR | 1045440 | A | 11/1953 |
| FR | 1170104 | A | 1/1959 |

OTHER PUBLICATIONS

ISA European Patent Office, International Search Report and Written Opinion Issued in Application No. PCT/EP2013/002816, Dec. 20, 2013, WIPO, 14 pages.

* cited by examiner

METHOD OF OPERATING A CRANE AND CRANE

CROSS REFERENCE TO RELATED APPLICATIONS

The present application is a U.S. National Phase of International Patent Application Serial No. PCT/EP2013/002816, entitled "METHOD OF OPERATING A CRANE AND CRANE," filed on Sep. 18, 2013, which claims priority to German Patent Application No. 10 2012 018 392.5, filed on Sep. 18, 2012, the entire contents of each of which are hereby incorporated by reference in their entirety for all purposes.

TECHNICAL FIELD

The invention relates to a method of operating a crane having a luffable crane boom and having a trolley arranged travelable at the crane boom, wherein the crane can be operated in a luffing mode, on the one hand, and in a trolley mode, on the other hand. The invention further relates to a crane which selectively allows a crane operation in trolley mode or in luffing mode.

BACKGROUND AND SUMMARY

Various crane systems are known from the prior art which offer certain advantages depending on the field of application. Revolving tower cranes having trolley booms are thus known in which the boom always adopts a horizontal position and in which the load can be traveled over the total boom length with the aid of a trolley. This provides the advantage that the suspended load can be moved particularly close to the tower.

In contrast, there are tower cranes having luffing booms which are also called variable booms. The luffing boom is fastened by a joint to the crane tower beneath the tower top and is variable in height via a boom guy rope. Such cranes do not have a trolley; the load is transported in the boom direction solely via the lifting and lowering movement of the boom. The named crane design above all provides advantages with tight space requirements since the boom can simply be "retracted" to avoid collisions with obstacles. In addition, the load can be raised to greater heights due to the steeper boom position.

An increasingly high degree of flexibility is in particular expected of mobile construction cranes which have a travelable, full-fledged revolving tower crane with a trolley boom. This crane structure is frequently intended to operate under complex spatial conditions at the construction site so that the aforesaid advantages of the luffing boom system are of great interest.

In the past, it has already been endeavored to merge the two proposed crane systems with one another. The advantages of the two different crane systems should in particular be combined in a single crane system.

A revolving tower crane is known from DE 1 171 132, for example, which has a retractable boom and a trolley guided thereat. The trolley is latched to the tip of the boom for the operation as a luffing boom. Any desired incline is hereby allowed for the boom system without the trolley leaving its position at the tip.

The support of the trolley at the boom tip, however, increases the unladen weight torque of the boom system and consequently reduces the possible peak payload in luffing operation. In addition, hoist rope length is lost due to the reeving of the hoist rope which can actually be needed with steep boom positions.

It is the object of the present invention to provide a crane or a method of operating a crane with which the initially named problem can be overcome.

This object is achieved by a method of operating a crane in accordance with the features of claim 1. Advantageous embodiments of the method in accordance with the invention are the subject of the subordinate claims dependent on the main claim.

Claim 1 therefore proposes a method of operating a crane having a luffable crane boom and having a trolley travelable at the crane boom. The crane configuration on the one hand allows crane operation in the luffing mode and on the other hand an operation in the trolley mode. The crane operator can selected the ideal crane mode based on the application and can convert the crane between the individual modes by carrying out the method.

The crane is, for example, configured as a revolving tower crane, in particular as a mobile construction crane, which comprises a luffing boom having a travelable trolley.

Previously known designs from the prior art propose fastening the trolley to the boom tip for the luffing mode and to let off the crane hook from the trolley. The present invention now takes a path which differs in decisive points. In accordance with the invention, the reeving of the hoist rope at the boom system is varied so that a luffing operation of the crane is made possible. The deflection of the hoist rope from the boom to the crane hook thus takes place independently of the trolley.

The re-reeving above all opens up the possibility of positioning the trolley at any desired position of the crane boom during the luffing operation. A support at the boom tip is no longer absolutely necessary, from which certain advantages result. For example, a positioning of the trolley close to the tower can have a favorable effect on the unladen weight torque of the crane.

Furthermore, not only an increase in the peak payload can be achieved during the luffing mode by a favorable choice of the fixing position, but also an increase in the effective crane outreach. The travel path of the trolley to the boom tip is limited as a rule by the technical circumstances so that the theoretically maximum outreach of the crane could not be ideally exploited either in the trolley mode or in the luffing mode. Due to the re-reeving in accordance with the invention, this disadvantage can be avoided during the luffing mode and the effective crane outreach can be increased.

It has been found to be particularly advantageous if, due to the re-reeving, a change is made between a single-line operation in the luffing mode and a multi-line operation, in particular a dual-line operation, in the trolley mode. Due to the re-reeving of the hoist rope into a single-line operation, additional hoist rope length can be gained which is in particular advantageous with steep boom positions in the luffing mode.

The hoist rope is beaten up to the boom system at the end side during the trolley mode. To change the reeving, it may be advantageous for the fixing point of hoist rope to be released for the crane operation in luffing mode and for it to be beaten up to a lifting hook or to be latched thereto. The crane is then operated in single-line operation. It is particularly expedient if a separate lifting hook is available for the luffing mode.

In a particularly advantageous embodiment, the trolley and/or the used crane hook/hook block of the trolley mode is latched to the boom or to the trolley for operation in the luffing mode. Since the latching of the trolley does not necessarily have to take place at the boom tip in the present invention, a latching positions is selected which is ideal with respect to the unladen weight of the trolley, which is expediently spaced apart from the boom tip and which reduces the unladen weight torque at the boom tip. A latching of the trolley close to the pivot connection point of the boom is particularly advantageous.

In this case, it can be advantageous to use an anyway present transport position or dismantling position for the trolley to latch it to the boom during the luffing mode. This transport position or dismantling position for the trolley is as a rule arranged in the region of the boom pivot connection point.

It is expedient in an advantageous embodiment of the invention to use a rope reeving pulley provided during the trolley mode as a deflection pulley during the luffing mode. The rope reeving pulley is as a rule arranged at the boom tip and serves the fixing or support of the hoist rope at the boom tip during the trolley mode. It is conceivable that the position of the rope reeving pulley for the luffing mode is directly spatially varied to be able to ensure an ideal deflection of the hoist rope.

It is of advantage for the re-reeving for the boom tip to be let down close to the ground. In this case, the re-reeving can be carried out comfortably and without any great effort from the ground by the crane operator. The boom tip is preferably let down close to the ground with an extended boom.

It is expedient for the re-reeving process with a let-down boom to secure the hoist rope to one or more securing means at the crane boom for safety reasons. The securing is preferably made before or shortly after the release of the fixing point of the hoist rope to the boom system. The hoist rope is released again before taking up the desired crane operation.

A fast and simple possibility can preferably be provided for a variable attachment of one or more additional elements to the boom, in particular to the boom tip. One or more boom elements can in particular be mounted to extend the boom to increase the useful boom length. The integration of other boom elements which provide additional functions at the boom system is, however, likewise conceivable. For example, individual elements or apparatus for the display of information can be attached to the boom tip. A combination of these elements with boom extensions is likewise conceivable.

The integration of one or more boom elements is facilitated by the letting down of the boom tip close to the ground. The boom can also be extended specifically for the luffing mode, which is not possible in the named fast and simple manner without any further effort in known trolley boom cranes due to the complexity of the trolley construction.

If one or more boom elements are mounted at the boom tip for the luffing mode, the hoist rope fixing point is released and is pulled out with the aid of a securing rope up to one of the additional boom elements, in particular up to the tip of the outer additional boom element. The securing rope is preferably guided from the outer tip of the outermost additional boom element up to the hoist rope fixing point for this purpose.

For the luffing mode, the hoist rope is expediently deflected by a deflection pulley attached to the additional boom element and is connected at the end side to the corresponding crane hook.

It is particularly advantageous if the rope reeving pulley is dismantled at the original boom during the trolley mode and is mounted at the corresponding additional boom element for the deflection of the hoist rope.

The hoist rope fixing point is preferably pulled up to the tip of the at least one additional boom element using a hand winch.

One or more sensors can detect the spatial geometry of the current crane configuration and can thus automatically recognize the planned crane mode, that is the luffing mode or trolley mode. The crane control can consequently work while taking account of the recognized crane mode and can release or carry out corresponding crane commands or functions.

The invention further relates to a crane, in particular to a revolving tower crane or to a mobile construction crane, having a luffable crane boom, in particular a luffing boom, and having a trolley arranged travelable at the crane boom. The proposed crane configuration allows the crane to be operated in a luffing mode, on the one hand, and in a trolley mode, on the other hand.

In accordance with the invention, the hoist rope of the crane is guided in the luffing mode via at least one deflection pulley at the crane boom, in particular at the boom tip, and is beaten up at the end side to a load hook or is latched thereto. The crane is characterized in accordance with the invention in that a one-line operation of the hoist rope is ensured during the luffing mode, whereas a multiple reeving of the hoist rope is necessary as a rule during the known trolley mode.

Certain advantages result from the single-line routing of the hoist rope during the luffing mode. For example, the position of the trolley is insignificant for the function of the crane in the luffing mode; a positioning close to the boom pivot-connection point is therefore possible. A larger hoist rope quantity is furthermore available by the single-line operation.

The crane in accordance with the invention advantageously moreover comprises means for carrying out the method in accordance with the invention or an advantageous embodiment of the method in accordance with the invention. The advantages and properties of the crane in accordance with the invention obviously correspond to those of the method in accordance with the invention so that a repeat description will be dispensed with at this point.

Further advantages and properties of the invention result from an embodiment described in more detail in the following drawings.

DETAILED DESCRIPTION

Figure 1:
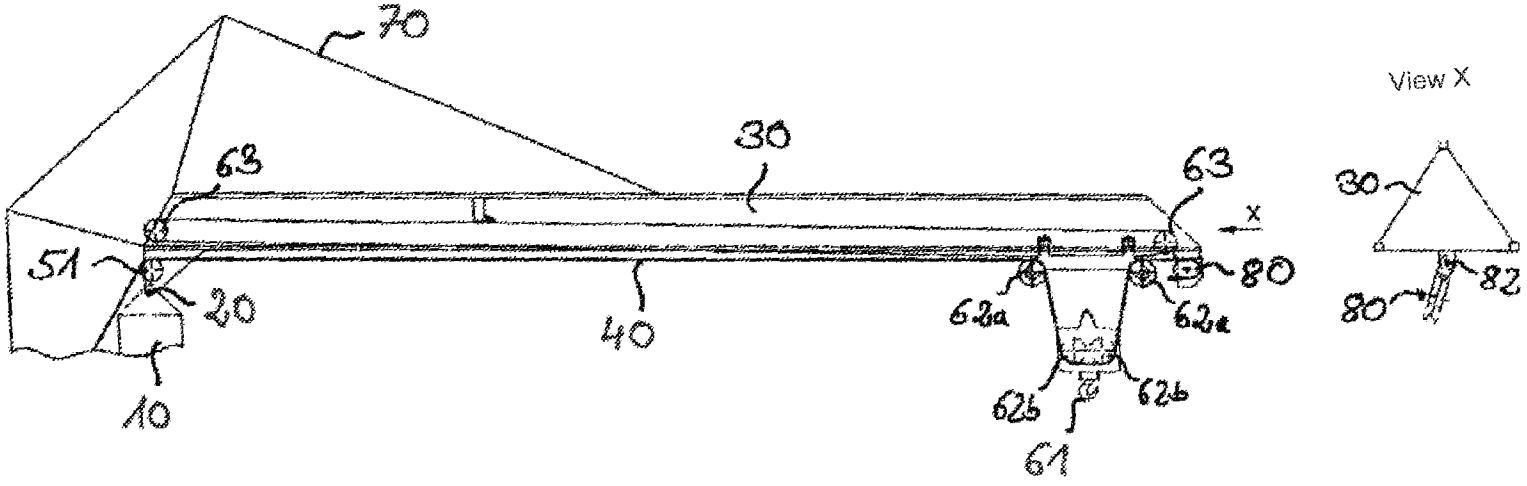
FIG. 1 shows a schematic side view of the crane in accordance with the invention during the trolley mode.

FIG. 1 shows a side view of the boom system of the crane in accordance with the invention. A luffing boom 30 is luffably pivotally connected to the head of the crane tower 10 about a horizontal luffing axis via a joint 20. A boom guying rope 70 extends from the crane tower 10 via the crane tip up to the boom 30 for adjusting the luffing angle. The boom 30 can be adjusted in the vertically extending luffing plane by actuating the boom guying rope 70.

The crane construction shown allows the crane operation in the luffing mode, that is with a luffable boom 30, and also trolley operation. The hoist rope 40 is used for both modes. The trolley 60, which can travel relative to the boom 30 in the latter's longitudinal axis, is available for the trolley mode. A respective rope pulley pair 62, 62*b* is arranged at the trolley 60 and at the hook block 61, whereby a two-line operation of the hoist rope during the trolley mode is made possible.

A trolley drive which comprises the two driven rope pulleys 63 and the associated rope arrangement 64 is provided for traveling the trolley 60.

The hoist rope 40 extends from the tower base via the boom pivotal connection point up to the boom tip. In the boom pivotal connection region, the hoist rope is guided via the rope pulley 51 and extends horizontally beneath the boom 30 in the direction of the boom tip. As already described, the hoist rope 40 is guided by the rope pulley pairs 62*a*, 62*b* of the trolley 60 or of the hook block 61 until it is deflected at the boom tip by the rope reeving pulley 80 and is fixedly connected to the boom structure at the end side in the region of the boom tip. The view X shows a front view of the boom tip. The rope reeving pulley 80 is pivotably connected to the boom tip via an axle 82 extending in parallel with the longitudinal boom axis.

Figure 2:
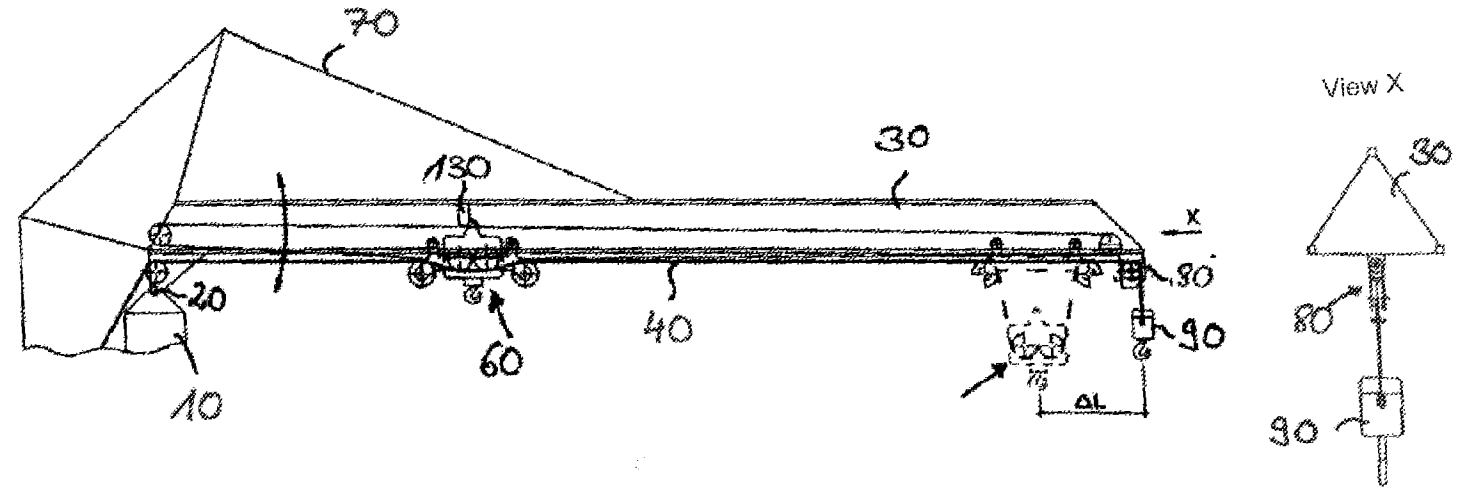
FIG. 2 shows a schematic side view of the crane in accordance with FIG. 1 in the luffing mode.

The representation in accordance with FIG. 2 shows the crane configuration which is operated during the luffing mode. The trolley 60 is fixed for this purpose at the anyway provided transport or dismantling latch position 130 and is held against a travel movement in the longitudinal axial direction of the boom 30. The hoist rope fixing point is released in the region of the boom tip with respect to the crane configuration of FIG. 1. The end of the hoist rope 40 is connected to a hook block 90 provided for the luffing operation or is latched thereto. The hoist rope 40 is admittedly still guided by the deflection pulleys 62*a*, 62*b* of the trolley 60 or of the hook block 61; however, this has no influence on the crane operation in the luffing mode.

In the region of the boom tip, the reeving pulley 80 is used as a deflection pulley to deflect the hoist rope at the boom tip to the hook block 90. The view X of FIG. 2 likewise shows a front view of the boom tip. The rope reeving pulley/deflection pulley 80 hangs perpendicular at the boom tip with a horizontally extending axis of rotation.

The trolley is not latched to the boom tip, but rather in a position, which is favorable with respect to its weight, further inwardly close to the tower 10, which results in an increase in the maximum crane payload. The crane operation is switched from a two-line operation in the trolley mode into a single-line operation in the luffing mode by the re-reeving of the hoist rope 40 for the luffing mode. Additional hoist rope length hereby becomes free, which is in particular of advantage with great hook heights having a steep boom position.

The effective outreach of the crane during the luffing mode can moreover be maximized with respect to trolley operation. As the dashed contours in FIG. 2 indicate, the trolley 60 cannot be completely traveled up to the boom tip due to the technical circumstances. The maximum possible outreach of the trolley 60 or of the crane hook 61 is smaller by the spacing $\Delta L$ from the boom tip.

The hoist rope 40 is deflected directly at the boom tip with the aid of the deflection pulley 80 by the change of the crane configuration in the luffing mode, whereby an outreach gain of $\Delta L$ is achieved. The system-induced loss of effective outreach during the trolley mode is consequently avoided in the luffing mode.

The following individual method steps are required for the change of the crane configuration starting from the trolley mode to the luffing mode:

Initially, the crane hook 90 for the luffing mode is set at the target destination at the ground still during the trolley mode. Subsequently, the trolley 60 and its hook 61 are latched at the boom 30 in the dismantling position 130. The boom tip is let down to the proximity of the ground with an extended boom 30 so that the hoist rope fixing point at the boom tip can be released from the ground. The released hoist rope 50 is secured at the boom 30 including the rope pulleys. The rope reeving pulley 80 is used as a deflection pulley 80 when dismantled. In this respect, the position of the rope reeving pulley 80 at the boom can be varied to be able to provide ideal conditions for the luffing mode.

The now free hoist rope fixing point is latched to the available hook 90. The hoist rope security is subsequently released and the boom 30 is pulled up.

In addition, one or more sensors are available at the crane which measure the local geometry at the boom system and which derive the current equipment status using the measured data. The result is communicated to the crane control or to the crane operator.

The above-described method steps are carried out in reverse order for the change of the crane configuration from the luffing mode to the trolley mode.

A simple possibility of changing the boom configuration during the conversion results by the change of the crane configuration, in particular by the change of the hoist rope reeving. One or more additional elements can be mounted particularly simply and fast at the boom tip for extending the boom 30 during the re-reeving of the hoist rope 40 with a let-down boom 30.

Figures 3A, 3B:
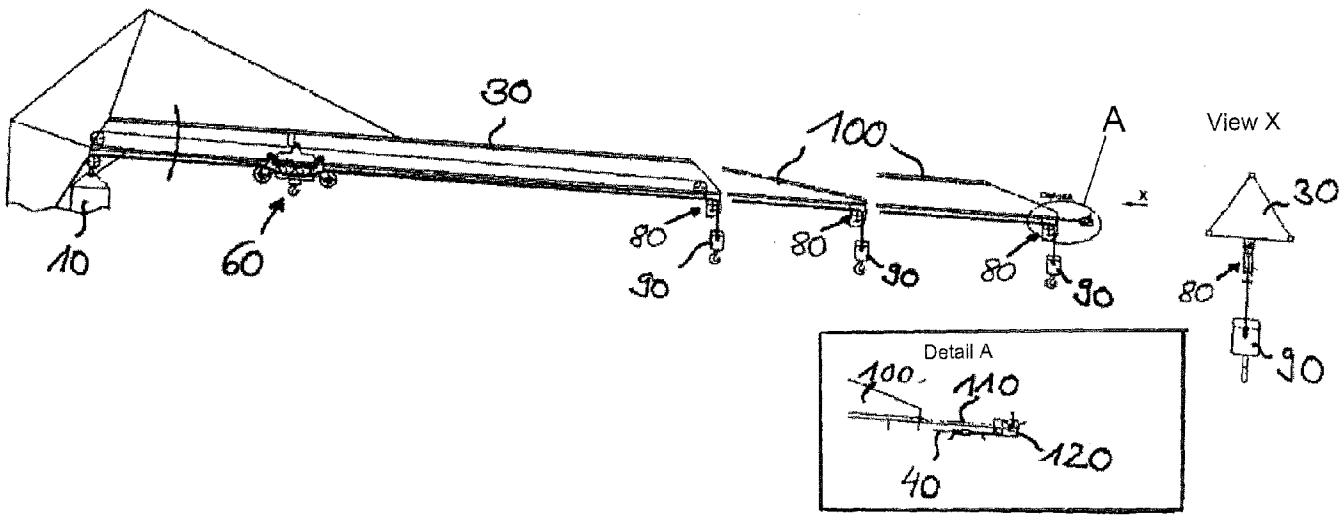
FIG. 3A shows a schematic side view of the crane in accordance with FIG. 2 with an extended boom tip.
FIG. 3B shows a detailed view of elements of FIG. 3A.

FIG. 3*a* schematically shows the possibility of extending the boom 30. A boom extension 100 such as a lattice tip can be mounted at the boom tip. Alternatively or additionally, other boom elements can also be introduced into the boom system for providing different functions. There is thus the possibility here of attaching individual elements or apparatus for displaying information to the boom tip. In this connection, reference is in particular made to the attachment of billboards or of electronic display means for the presentation of advertising information.

The above-described method for mode changing is made use of for the mounting of a boom extension or of an additional boom element. At least one extension 100 or on additional element, is, however, provided in advance in addition to the crane hook 90.

The method is subsequently carried out up to the securing of the hoist rope 40. The mounting of the boom extension 100 at the boom tip subsequently takes place. As shown in the detailed view in accordance with FIG. 3*b*, the hoist rope fixing point is connected for this purpose to a securing rope 110 which extends up to the tip of the boom extension 100. The securing rope 110 can be wound up onto a hand winch 120 to pull the hoist rope from the boom tip up to the outer end of the boom extension 100. The rope reeving pulley 80 is dismantled at the boom tip and is fastened to the tip of the boom extension 100. The hoist rope 40 and the reeving pulley 80 are secured at the new position up to the erection of the boom 30. The rope reeving pulley 80 mounted at the boom extension takes over the function of a deflection pulley 80 for guiding the hoist rope 40 up to the crane hook 90. A provided sensor system also recognizes the changed configuration in this case and communicates it to the crane control.

The invention now allows a fast change of the crane configuration between the trolley mode and the luffing mode with little equipping effort. The crane in accordance with the invention and the method in accordance with the invention ensure a particularly flexible crane deployment at construction sites with particularly tight space conditions.

The invention claimed is:

1. A method of operating a crane having a luffable crane boom and having a trolley arranged travelable at the crane boom, wherein the crane is operable in a luffing mode and in a trolley mode, wherein a change of a hoist rope reeving takes place for a mode change, wherein a one-line operation of a hoist rope takes place in the luffing mode and a two-line operation of the hoist rope takes place in the trolley mode.

2. The method in accordance with claim 1, wherein a mount point of the hoist rope is released for crane operation in the luffing mode, and wherein during the trolley mode, the mount point is fixed at a boom tip.

3. The method in accordance with claim 2, wherein the hoist rope is secured at the crane boom after a release of the mount point up to a starting of the luffing operation at the crane boom.

4. The method in accordance with claim 2, wherein the reeving pulley is located at a tip of the boom, the tip being spaced away from a tower.

5. The method in accordance with claim 4, wherein the tip of the boom is operated as a mount for the mount point of the hoist rope in the trolley mode, and the reeving pulley is operated as a deflection pulley in the luffing mode.

6. The method in accordance with claim 1, wherein the trolley or a hook block of the trolley are latched to the boom during the luffing mode.

7. The method in accordance with claim 6, wherein the trolley or the hook block of the trolley are latched in a transport/dismantling position.

8. The method in accordance with claim 1, wherein the hoist rope is fixed to the boom in the trolley mode, with a rope reeving pulley being used as a deflection pulley in the luffing mode and with a position of the pulley or of a support being locally changeable.

9. The method in accordance with claim 1, wherein a boom tip is let down to close to the ground for re-reeving the hoist rope for the corresponding crane mode.

10. The method in accordance with claim 9, wherein at least one additional boom element for the luffing mode is mounted during the hoist rope re-reeving, with the hoist rope mount point being connected to a securing rope, starting from the at least one additional boom element, and is pulled out up to the tip of the additional boom element.

11. The method in accordance with claim 10, wherein the hoist rope mount point is pulled with a hand winch up to a tip of the at least one additional boom element.

12. A crane having a luffable crane boom and having a trolley arranged travelable at the crane boom, wherein the crane is operable in a luffing mode and in a trolley mode, wherein a hoist rope is guided via at least one deflection pulley at a tip of the crane boom and is fixed at an end side to a load hook or is latched thereto in the trolley mode, wherein, in the luffing mode, the hoist rope is arranged in a single-line reeving, and wherein, in the trolley mode, the hoist rope is arranged in a two-line reeving.

13. The crane in accordance with claim 12, wherein a mount point of the hoist rope is released from the tip of the crane boom for crane operation in the luffing mode.

14. The crane in accordance with claim 13, wherein the tip of the crane boom is spaced away from a tower.

15. The crane in accordance with claim 13, wherein the hoist rope is secured together with hoist rope pulleys during a re-reeving of the hoist rope after a release of the hoist rope up to a starting of the luffing operation at the crane boom.

16. The crane in accordance with claim 15, wherein at least one additional boom element for the luffing mode is mounted during the re-reeving of the hoist rope, with the hoist rope being connected to a securing rope, starting from the at least one additional boom element, and is pulled out up to a tip of the additional boom element.

* * * * *